US005787565A

United States Patent [19]

Matsuo et al.

[11] Patent Number: 5,787,565

[45] Date of Patent: Aug. 4, 1998

[54] CONTINUOUS ROLLING METHOD

[75] Inventors: Giichi Matsuo; Soichi Aoyama; Akira Sakai, all of Tokyo, Japan

[73] Assignee: NKK Corporation, Tokyo, Japan

[21] Appl. No.: 677,037

[22] Filed: Jul. 8, 1996

[30] Foreign Application Priority Data

Aug. 31, 1995 [JP] Japan ..... 7-223399

[51] Int. Cl.[6] ..... B21B 1/46; B21B 1/18

[52] U.S. Cl. ..... 29/526.4; 29/527.5; 29/527.7

[58] Field of Search ..... 29/527.5, 527.7, 29/526.4, 526.2

[56] References Cited

U.S. PATENT DOCUMENTS

| | | | |
|---|---|---|---|
| 2,680,938 | 6/1954 | Peterson . | |
| 4,294,394 | 10/1981 | Iida et al. | 29/527.7 X |
| 5,205,471 | 4/1993 | Kinose et al. | 29/527.7 |
| 5,490,315 | 2/1996 | Kostopolos et al. | 29/527.7 |
| 5,579,569 | 12/1996 | Tippins et al. | 29/527.7 |
| 5,611,232 | 3/1997 | Rohde et al. | 29/527.7 X |

FOREIGN PATENT DOCUMENTS

| | | |
|---|---|---|
| 52-43754 | 4/1977 | Japan . |
| 57-11722 | 3/1982 | Japan . |

*Primary Examiner*—Horace M. Culver

*Attorney, Agent, or Firm*—Frishauf, Holtz, Goodman, Langer & Chick

[57] ABSTRACT

Billets 10 which were continuously cast in a continuous casting machine 1 are directly supplied to a joining line 12. Scale on the billets is removed by a de-scaling apparatus 3. Then the rear end of a preceding billet is welded with the front end of a succeeding billet using a travelling flash butt welder 4 to produce a continuous billet. A burr on the welded part 15 is removed by grinders 51–53 in a travelling burr-removing apparatus 5. The continuous billet is heated in an induction heater 6, and then is continuously rolled in a rolling mill line.

9 Claims, 4 Drawing Sheets

CONTINUOUS ROLLING METHOD

BACKGROUND OF THE INVENTION

1. Field of the Invention

The present invention relates to a method of hot direct continuous rolling wherein hot billets cast by a continuous casting machine are supplied directly to a rolling mill while maintaining high temperature as cast and wherein the billets are continuously joined and subsequently continuously rolled to produce steel bars and wire rods.

2. Description of the Related Art

A hot direct rolling (HDR) method is known as a rolling method for producing wire rods, steel bars, or to shape steel with high efficiency and increased energy saving. The HDR method directly supplies continuously cast billets to a rolling mill in an as cast state, or supplies the billets to a rolling mill line after heated them to an adequate temperature through a heating system. The billets are then rolled continuously. This method, however, rolls the billets successively one by one so that the production yield is poor and only a short length of product can be achieved. Accordingly, a continuous rolling method in which billets are continuously joined together before rolling has recently been tried to further improve efficiency. That type of continuous rolling method is disclosed in JP-A 52-43754, for example (wherein the term "JP-A" signifies a "Japanese unexamined patent publication"). According to the disclosure, a billet which was continuously cast is once cooled, then is heated to an adequate temperature in a heating furnace. A rear end of the billet coming from the furnace is joined with the front end of the succeeding billet coming from the heating system using a travelling flash butt welder. Then a scarfer is applied to remove a burr from the butt-welded part. The thus joined continuous bullet is re-heated by an induction heater, and is continuously rolled in a rolling mill line.

A conventional continuous rolling method, however, does not directly connect the billet cast line with the billet rolling line.

Consequently, both the billet heating process and the billet re-heating process are indispensable. As a result, the heat held by the billet cannot be utilized, which is a disadvantage of the method from the energy saving point of view and which results in a large scale production line and a great cost.

Alternatively, a method for conducting billet heating and re-heating in a single furnace is proposed (JP-B 57-11722 (1982)), wherein the term "JP-B" signifies a "Japanese examined patent publication"). The method is similar to the above-described conventional method in that both a billet heating process and billet re-heating process are necessary. In addition, the method requires the billet to be brought from the furnace in the opposite direction against the rolling direction before joining it with another billet, then requires a change or direction of the billet charge to enter the joining process, the welded part burr-removing process, the re-heating process (in the same furnace), and the rolling process. Accordingly, the method results in large heat loss and unavoidably needs a large scale installation and a great cost.

Furthermore, the methods described in JP-A-52-43754 and in JP-B-57-11722 are ones which forcefully peel off the burr on the welded part using a tool such as a forming tool, so that the wear of the tool becomes severe, resulting in an unsuitable practical application.

SUMMARY OF THE INVENTION

The present invention aims to solve the above-described problems and to realize a continuous rolling at high efficiency under energy saving while minimizing the scale of a production line. The object of the present invention is to provide a method of hot direct continuous rolling which combines the advantages of the above-described direct supply rolling method and the continuous rolling method to enhance the characteristics of the two methods.

The continuous rolling method of the present invention comprises the steps of:

casting billets by a continuous casting machine;

supplying the billets successively one after another from the continuous casting machine to a rolling mill while the billets hold heat obtained through casting;

joining a rear end of the preceding billet with a front end of the succeeding billet using the flash butt welding method during travelling to produce a continuous billet;

removing a burr formed by the flash butt welding on the welded part of the continuous billet using a grinding machine during travelling;

heating the continuous billet to a specified temperature using an induction heater; and rolling the heated continuous billet through the rolling mill line.

The method further comprises the step of removing scale on the billet before applying the flash butt welding using a hydraulic pressure de-scaling apparatus or a mechanical de-scaling apparatus.

In the above-described method, a plurality of grinders are arranged along the outer periphery of the billet under a condition of an equal inclination angle and of inclination against the center axis of the continuous billet to remove the burr from the welded part.

In the above-described method, a plurality of grinders are arranged separately along the travelling direction of the continuous billet to remove the burr from the welded part.

BRIEF DESCRIPTION OF THE DRAWINGS

FIG. 5(*b*) is a sectional view of a continuous billet after the burr is removed.

FIG. 7(*b*) is a schematic front view of a travelling burr-removing apparatus for a square billet.

DESCRIPTION OF THE PREFERRED EMBODIMENT

Figure 1:
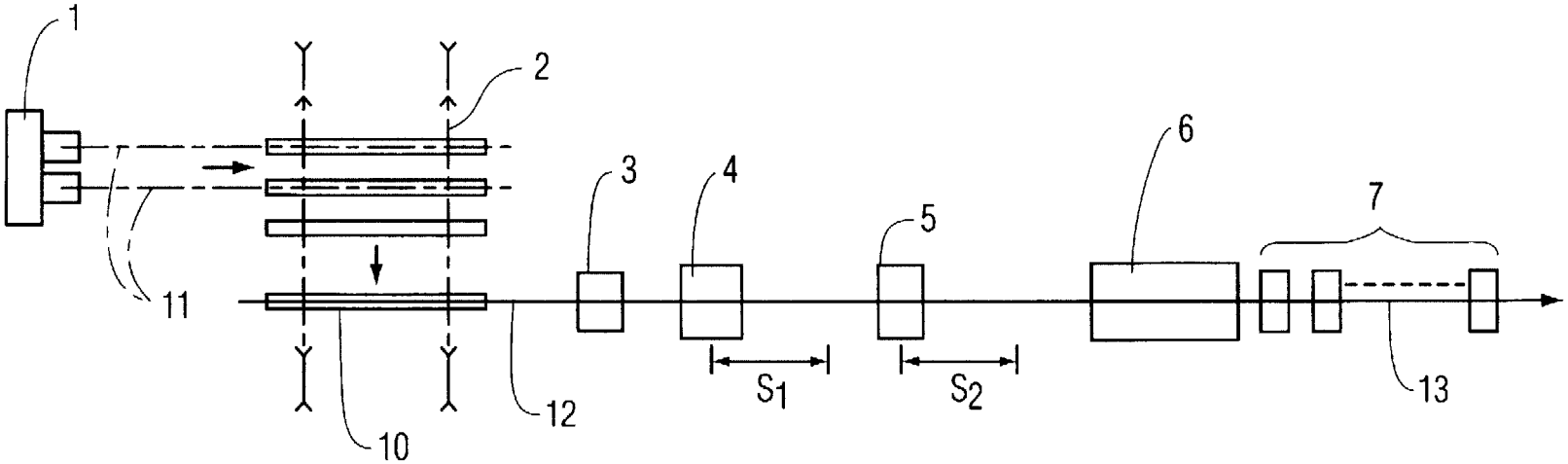
FIG. 1 shows a schematic drawing of a hot direct continuous rolling apparatus for the present invention.

FIG. 1 is a schematic drawing of a hot direct continuous rolling facility of the present invention illustrating a flat arrangement of individual components.

In FIG. 1, the reference numeral 1 denotes a continuous casting machine. In this embodiment the continuous casting machine has two strands. A casting line 11 and a rolling line 13 are parallel in each other. The billets 10 are continuously cast by the continuous casting machine 1. The billets are transferred onto the chain conveyer 2 which is located orthogonally to a billet joining line 12. The billet joining line 12 is linearly connected to an upstream end of the rolling line 13. On the joining line 12, are arranged a de-scaling apparatus 3, a travelling flash butt welder 4, a travelling burr-removing apparatus 5, and an induction heater 6 in order from an upstream side. The reference numeral 7 is a rolling mill line including a plurality of rolling mill stands forming a rolling line 13.

The de-scaling apparatus 3 removes the scale from the billet 10 using, for example, injection of high pressure water or a rotating brushing machine. The de-scaling improves electric conduction during flash butt welding, and prevents damage of an electrode face. The portion to de-scale on the billet 10 does not necessarily cover the whole length of the billet, and it may be limited to the front end part and the rear end part of the billet 10 where the electrode for flash butt welding touches. Both end faces on the billet 10 are preferably de-scaled.

Figure 2:
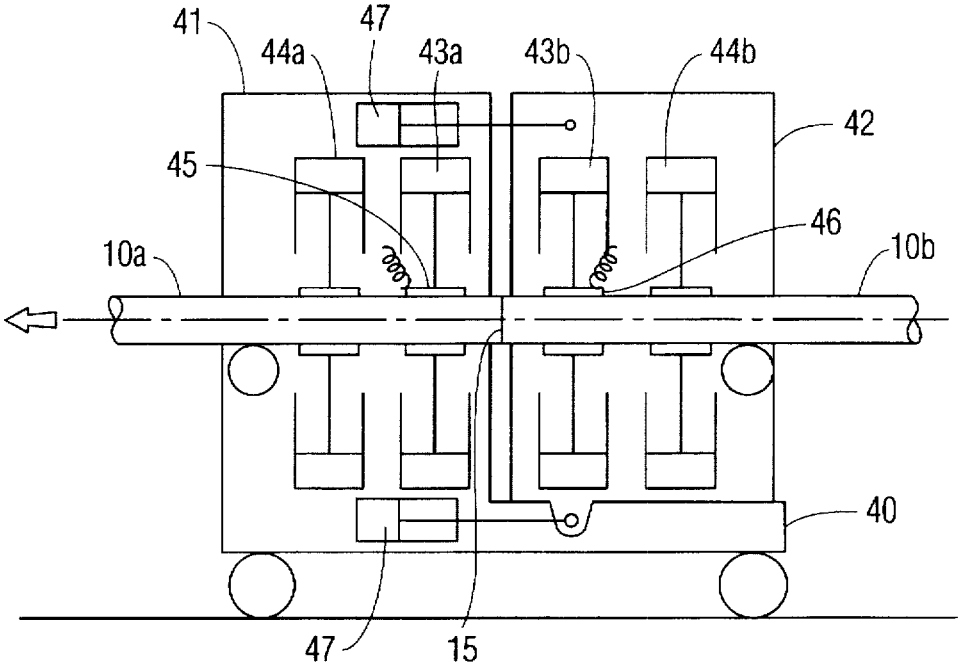
FIG. 2 shows a schematic drawing of a travelling flash butt welder for the present invention.
Figure 3:
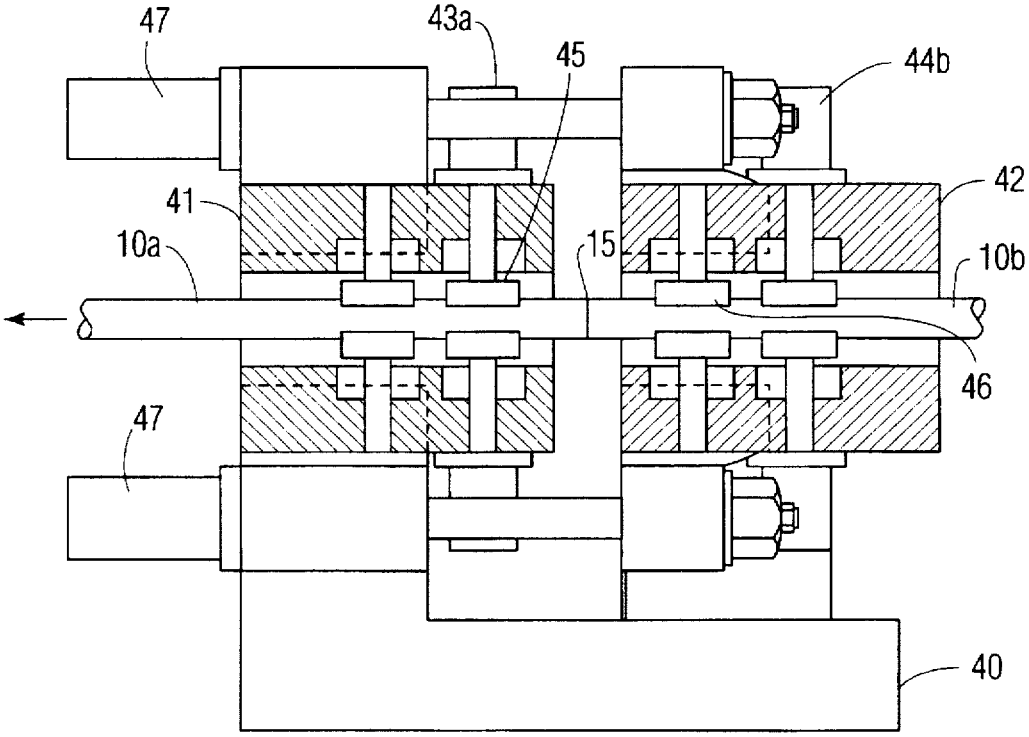
FIG. 3 is a side view partly in section of internal clamp of the above-illustrated flash butt welder.
Figure 4:
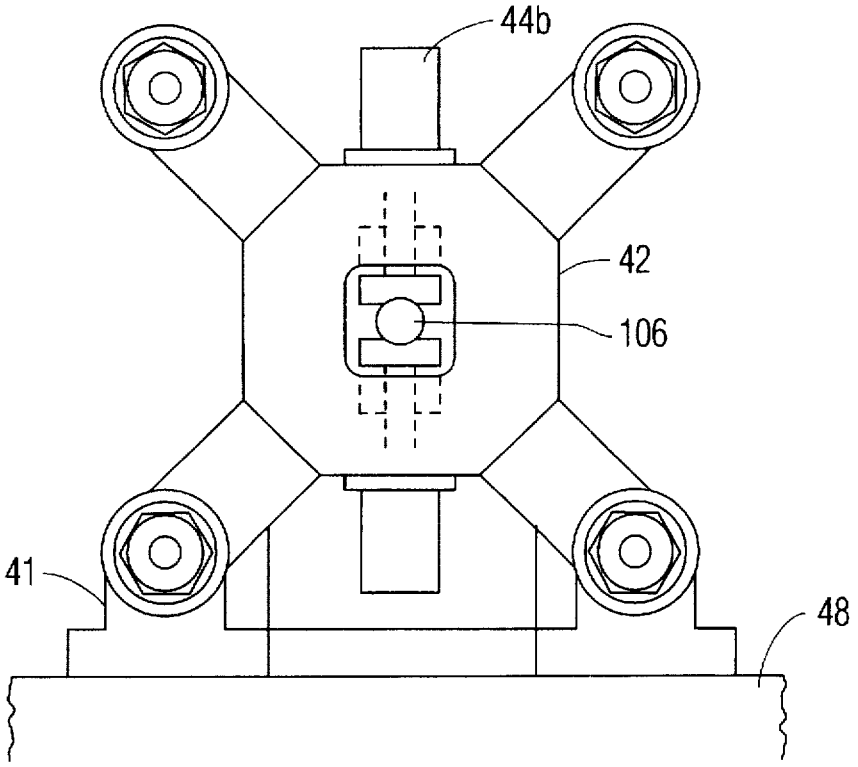
FIG. 4 is a front view of the internal clamp of the above-illustrated flash butt welder illustrated in FIG. 3.

FIG. 2 shows a schematic drawing of a travelling flash butt welder. FIG. 3 is a side view partly in section of internal clamp of the flash butt welder. FIG. 4 is a front view of the internal clamp of the above-illustrated flash butt welder.

The welder 4 is provided with a stationary head 41 and a moving head 42 within a travelling body 40, and with a plurality of hydraulic cylinders 43*a*, 44*a*, and 43*b*, 44*b* to clamp the preceding billet 10*a* and the succeeding billet 10*b*, respectively, on each head. A clamp body on the hydraulic cylinder 43*a* and the hydraulic cylinder 43*b*, which are close to the billet ends form the electrode 45, 46, respectively. The stationary head 41 and the moving head 42 are connected each other by a plurality of upset hydraulic cylinders 47. The hydraulic cylinders 43*a*, 43*b* for driving the electrodes are positioned as near to the edges of the billet as possible.

Figure 5A:
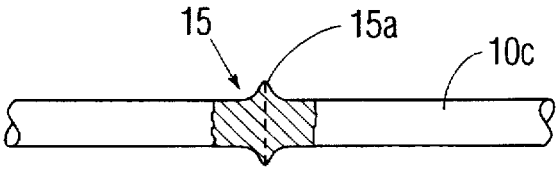
FIG. 5(*a*) is a sectional view of a continuous billet before removing the burr from a welded part.
Figure 5B:
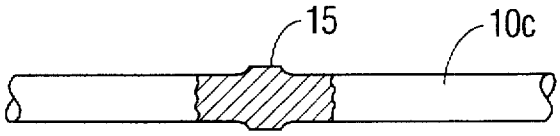

FIG. 5(*a*) is a sectional view of a welded part 15 formed by flash butt welding of the rear end of the preceding billet 10*a* with a front end of the succeeding billet 10*b* using the welder 4. The upset of flash butt welding raises the welded part 15 from the external periphery, so the burr 15*a* is removed by the travelling burr-removing apparatus 5 described below.

Figure 6:
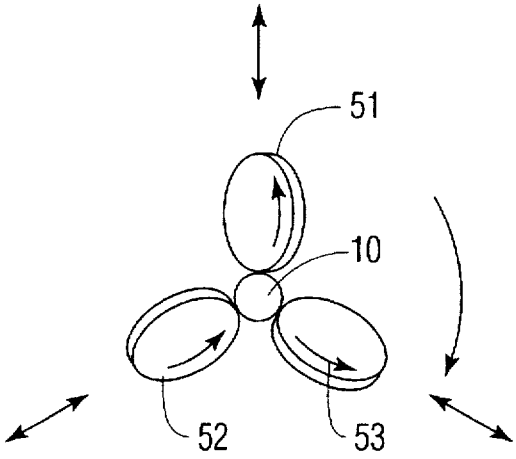
FIG. 6 shows a schematic front view of a travelling burr-removing apparatus for a round billet.
Figure 7A:
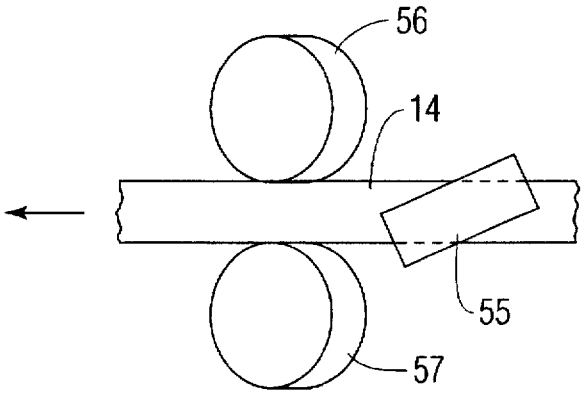
FIG. 7(*a*) is a schematic side view of a travelling burr-removing apparatus for a square billet.
Figure 7B:
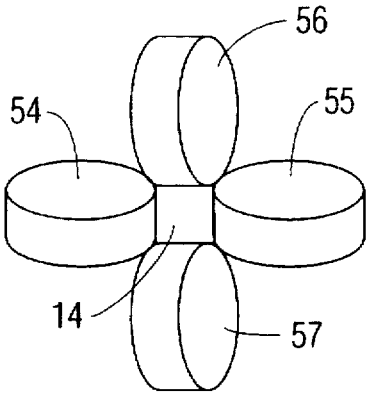

FIG. 5(*b*) shows the billet after removing the burr from the welded part. FIG. 6 shows a schematic drawing of a travelling burr-removing apparatus for a round billet. FIG. 7(*a*) is a schematic side view of a travelling burr-removing apparatus for square billets and FIG. 7(*b*) is a schematic front view of the apparatus.

The burr-removing apparatus 5 shown in FIG. 6 comprises a plurality of grinders 51 through 53 which are independently driven by motors and which are arranged along the outer periphery of a continuous billet 10*c* at a uniform spacing such that each of the grinders 51–53 is arranged to have an inclined angle against the center axis of the continuous billet 10*c* and such that each of the grinders 51–53 together rotates around the continuous billet 10*c*. In addition, each of the grinders 51 through 53 is movable in the radial direction of the continuous billet 10. By arranging each of the grinders 51–53 at an inclined angle against a center axis of billet 10, a relatively thin grinder can remove a wide range of the burr 15*a* from the welded part 15.

For the case of round billet 10, by rotating a plurality of grinders 51–53 around the round billet 10, the burr 15*a* can be removed as shown in FIG. 5(*b*).

For the case of a square billet 14, the grinders 54–57 are arranged around the square billet 14 as shown in FIG. 7(*a*) and FIG. 7(*b*), and the grinders are arranged at tilted positions with the pair of right and left grinders, 54, 55, displaced from the pair of top and bottom grinders, 56, 57, along the travelling direction of the square billet 14, thus avoiding mechanical interference between these pairs. Accordingly, the burr is removed by a two-step operation in that case.

Since the induction heater 6 and the rolling mill line 7 are known devices, a detailed illustration is not given.

The method of the present invention will be described along with the operation thereof.

As shown in FIG. 1 the billets 10 are continuously cast by the continuous casting machine 1 and then are transferred onto, for example, the chain conveyer 2, or are taken out successively, and then they are directly supplied successively to the joining line 12. The directly supplied billets 10 travel with a nearly equal interval therebetween. First, on the de-scaling apparatus 3, the scale mainly on the ends, front end, and rear end of the billet is removed by hydraulic or mechanical means. Next, the preceding billet 10*a* and the succeeding billet 10*b* are separately clamped by the hydraulic cylinders 43*a*, 44*a*, and 43*b*, 44*b*, respectively, while the travelling flash butt welder 4 travels at nearly equal speed with that of the billets 10. Thus the upset hydraulic cylinder 47 brings the succeeding billet 10*b* close to the preceding billet 10*a* to contact each other. A large current is applied to both ends of the billets through the electrodes 45, 46, to send out flashes repeating short circuits and archings and to bring both ends to a fused state. The upset hydraulic cylinder 47 applies upset to the succeeding billet 10*b* to join with the preceding billet 10*a*. The flash butt welder 4 conducts the flash butt welding during the period of travelling through the specified stroke S1 shown in FIG. 1 at an equal speed with that of the billet transfer. When the welding is completed, the flash butt welder 4 returns to the original position. The welder 4 repeats the flash butt welding to Thus join the continuous billet 10*c* with a further succeeding billet 10*b*. In this manner, the billets 10 are successively joined together by the flash butt welding.

The burr 15*a* on the welding part 15 is continuously removed by the travelling burr-removing apparatus 5. That is, when the apparatus 5 detects the welded part 15 on the continuous billet 10*c*, it moves the grinders 51–53 which are kept to rotate at a constant speed toward the center of the billet using a hydraulic cylinder while the apparatus is travelling downstream. The grinders touch the billets 10*c*, and they are preset at a given position. The billet 10*c* is further transferred downstream. When the welded part 15 of the continuous billet 10*c* reaches the lower face of the grinders 51–53, the driving current of the drive motor suddenly increases, and the arrival of the welded part 15 is detected by the sudden change in current. When the welded part 15 reaches the lower face of the grinders 51–53, the rotating grinders 51–53 start to rotate around the continuous billet 10*c*, keeping the preset position. Thus the burr 15*a* on the whole periphery of the continuous billet 10*c* is ground. Also the burr-removing apparatus 5 conducts the burr-removal during a period of travelling through the specified stroke S2 shown in FIG. 1. After completing the burr-removing cycle, the apparatus 5 returns to the original position, and repeats the burr-removing operation to the following welding part 15. Thus the burrs on the welded part 15 are continuously removed.

In the case that square billets 14 are treated, the grinders 54 through 57 are arranged as shown in FIG. 7. By approaching the billet beginning from the upstream grinders 54, 55, burrs on the right and left sides are removed first. Secondarily the burr on top and bottom sides are removed in two step grinding.

As described above, the continuous billet 10*c* is subjected to the burr-removing action on each welded part 15 in the travelling burr-removing apparatus 5 and transferred into the induction heater 6 where the continuous billet 10*c* is heated to a temperature of from 950° to 1050° C., and further the heated continuous billet 10*c* is treated by continuous rolling in the rolling mill line 7.

Accordingly, the continuously cast billets 10 are directly charged successively to pass through the de-scaling step, the travelling flash butt welding step, the travelling burr-removing step, the heating step, and the continuous rolling step. Thus the billet heating step is a single process to heat up only by 100° C.–200 ° C., which significantly contributes to energy saving and which enables high efficiency continuous rolling without increasing the scale of the production line. Since the flash butt welding is performed while the directly supplied billets hold a high temperature at around 800° to 900° C., the preheating time for the flash butt welding is shortened, which then shortens the welding time and shortens the cycle time. The adoption of the flash butt welding eliminates the possibility of inclusion of impurities in the welded part on upsetting, and the change in structure is very slight, so that the joint strength is nearly equal with that of the mother material (billet). The flash butt welding also induces no problem of product character. Furthermore, the burr raised by upset at the welded part of the external periphery of the billet is removed by grinders during the billet travelling period, so that the burr-removal is readily carried out within a short time of burr-removing. The grinding may be carried out with grinding wheels so that the grinding performance may be sustained for a long time even under an abraded state of the grinders.

The continuous billets thus joined together are heated to a temperature of from 950° to 1050° C. in an induction heater, and then they are continuously rolled by the rolling mill line.

As described above, the present invention adopts a series of continuous rolling steps for directly supplied billets which were continuously cast, and high efficiency continuous rolling under an energy saving condition is achieved without increasing the scale of the production line. In addition, the billet welding time and the burr-removing time at the welded part are shortened at HDR condition, so the cycle time is shortened.

What is claimed is:

1. A continuous rolling method comprising the steps of:

casting billets by means of a continuous casting machine;

supplying the billets successively one after another from the continuous casting machine to a rolling mill while the billets hold heat obtained through casting;

joining a rear end of a preceding billet with a front end of a succeeding billet by flash butt welding during travelling of the preceding and succeeding billets so as to produce a continuous billet;

removing a burr formed by the flash butt welding on a welded part of the continuous billet using a grinder during travelling of the continuous billet;

heating the continuous billet to a specified temperature using an induction heater; and rolling the heating continuous billet through a rolling mill line.

2. The method of claim 1 further comprising the step of removing scale on the preceding and succeeding billets before the flash butt welding thereof by using a hydraulic pressure de-scaling apparatus.

3. The method of claim 2, wherein the step of removing scale on the preceding and succeeding billets comprises removing scale from a part of the preceding and succeeding billets that contacts with electrodes for effecting the flash butt welding.

4. The method of claim 1 further comprising the step of removing scale on the preceding and succeeding billets before the flash butt welding thereof by using a mechanical de-scaling apparatus.

5. The method of claim 4, wherein the mechanical de-scaling apparatus comprises a brush descaling apparatus.

6. The method of claim 1, wherein the step of removing a burr on the welded part comprises arranging a plurality of grinders along an outer periphery of the continuous billet at an equal angular spacing and at an inclined angle against a center axis of the continuous billet.

7. The method of claim 6, wherein the grinders comprise grinding wheels.

8. The method of claim 1, wherein the step of removing a burr on the welded part comprises arranging a plurality of grinders along a travelling direction of the continuous billet while displacing a location of the grinder.

9. The method of claim 8, wherein the grinders comprise grinding wheels.

* * * * *

UNITED STATES PATENT AND TRADEMARK OFFICE

CERTIFICATE OF CORRECTION

PATENT NO. : 5,787,565

DATED : August 4, 1998

INVENTOR(S) : MATSUO et al.

It is certified that error appears in the above-identified patent and that said Letters Patent is hereby corrected as shown below:

On the title page:

Item [56] References Cited, under "FOREIGN PATENT DOCUMENTS", insert --2,836,338 2/1980 Germany 0,053,274 A1 6/1982 Europe 4,009,861 A1 10/1991 Germany 54-1264 1/1979 Japan--;

Item [56] References Cited, under "OTHER PUBLICATIONS", insert --PATENT ABSTRACTS OF JAPAN, Vol. 7, No. 79 (M-204), March 31, 1983 & JP-A-58 006702 (NIPPON KOKAN K.K.), January 14, 1983.

UNITED STATES PATENT AND TRADEMARK OFFICE

CERTIFICATE OF CORRECTION

PATENT NO. : 5,787,565
DATED : August 4, 1998
INVENTOR(S) : MATSUO et al.

It is certified that error appears in the above-identified patent and that said Letters Patent is hereby corrected as shown below:

PATENT ABSTRACTS OF JAPAN, Vol. 3, No.27 (C-39), March 7, 1979 & JP-A-54 001264 (SHIN NIPPON SEITETSU), January 8, 1979.

PATENT ABSTRACTS OF JAPAN, Vol. 11, No. 155 (M-589), May 20, 1987 & JP-A-61 286004 (MITSUBISHI), December 16, 1986.

PATENT ABSTRACTS OF JAPAN, Vol. 10, No. 122 (M-476), May 7, 1986 & JP-A-60 250811 (SUMIMOTO), December 11, 1985.

UNITED STATES PATENT AND TRADEMARK OFFICE

CERTIFICATE OF CORRECTION

PATENT NO. : 5,787,565

DATED : August 4, 1998

INVENTOR(S) : MATSUO et al.

It is certified that error appears in the above-identified patent and that said Letters Patent is hereby corrected as shown below:

DATABASE WPI, Section Ch, Week 7809 Derwent Publications Ltd. London, G.B. Class M21, AN 78-16601A XP002019939 & JP-B-57 011 722 (MITSUBISHI), January 18, 1978.--;

Column 1, line 8, after "cast" insert --,--;

line 46, change "(1982))" to --(1982)--;

line 53, change "or" to --of--;

Column 4, line 38, change "Thus" to --thus--;

Column 5, line 3, change "the burr on" to --, burrs on the--.

Signed and Sealed this

Sixth Day of March, 2001

Nicholas P. Godici

*Attest:*

NICHOLAS P. GODICI

*Attesting Officer*

*Acting Director of the United States Patent and Trademark Office*